US009228311B2

(12) United States Patent
Taylor et al.

(10) Patent No.: US 9,228,311 B2
(45) **Date of Patent: *Jan. 5, 2016**

(54) SHORING BOX AND RELATED METHODS

(71) Applicant: Taymurf Shoring, LLC, Yucaipa, CA (US)

(72) Inventors: Andrew Taylor, Yucaipa, CA (US); Thomas Murphy, Glendora, CA (US)

(73) Assignee: TAYMURF SHORING LLC, Yucaipa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/322,274

(22) Filed: Jul. 2, 2014

(65) Prior Publication Data

US 2014/0314500 A1 Oct. 23, 2014

Related U.S. Application Data

(63) Continuation of application No. 13/663,314, filed on Oct. 29, 2012, now Pat. No. 8,845,239.

(60) Provisional application No. 61/553,006, filed on Oct. 28, 2011.

(51) Int. Cl.
*E02D 17/08* (2006.01)
*E02D 17/04* (2006.01)

(52) U.S. Cl.
CPC ..... *E02D 17/04* (2013.01); *E02D 17/08* (2013.01); *Y10T 29/49826* (2015.01)

(58) Field of Classification Search
CPC ..... E02D 17/08
USPC ..... 405/272, 273, 274, 282, 283
See application file for complete search history.

(56) References Cited

U.S. PATENT DOCUMENTS

| | | | | | |
|---|---|---|---|---|---|
| 4,310,267 | A * | 1/1982 | Davis | 405/283 |
| 4,657,442 | A * | 4/1987 | Krings | 405/282 |
| 4,685,837 | A * | 8/1987 | Cicanese | 405/282 |
| 5,158,398 | A * | 10/1992 | Pinho | 405/282 |
| 5,669,738 | A * | 9/1997 | Kundel | 405/282 |
| 5,931,607 | A * | 8/1999 | Hess | 405/282 |
| 6,224,296 | B1 * | 5/2001 | Fukumori | 405/282 |
| 6,443,665 | B1 * | 9/2002 | Kundel, Sr. | 405/283 |
| 6,848,865 | B2 * | 2/2005 | Kadiu | 405/272 |
| 7,021,868 | B1 * | 4/2006 | Farrag et al. | 405/283 |
| 7,056,068 | B2 * | 6/2006 | Kadiu | 405/282 |
| 7,309,191 | B2 * | 12/2007 | Kadiu | 405/282 |
| 8,613,573 | B2 * | 12/2013 | Kadiu | 405/282 |
| 8,845,239 | B2 * | 9/2014 | Taylor et al. | 405/282 |
| 2009/0110490 | A1 * | 4/2009 | Hess | 405/282 |

* cited by examiner

*Primary Examiner* — Frederick L Lagman
(74) *Attorney, Agent, or Firm* — Coastal Patent Law Group, P.C.

(57) ABSTRACT

A shoring box having frame supports coupled to lateral spreader bars. The shoring box is configured to accept exterior panels in a manner capable of providing vertical translation about an exterior surface of the shoring box. The shoring box is further configured to accept a plurality of interior panels in a manner capable of providing customizable shoring above and below utility lines, pipes, duct banks, and the like. In this regard, the shoring box is adapted to shore around one or more obstructions within an excavation, trench, or hole.

6 Claims, 13 Drawing Sheets

SHORING BOX AND RELATED METHODS

CROSS-REFERENCE TO RELATED APPLICATIONS

This application is a continuation of U.S. Ser. No. 13/663,314, filed Oct. 29, 2012, now U.S. Pat. No. 8,845,239, issued Sep. 30, 2014;

which claims benefit of priority with U.S. Provisional Application Ser. No. 61/553,006, filed Oct. 28, 2011, titled "SHORING BOX & RELATED METHODS";

the contents of each of which are hereby incorporated by reference.

BACKGROUND OF THE INVENTION

1. Field of the Invention

This invention relates to shoring boxes and related methods for use in shoring open excavations; and more particularly to an improved shoring box adapted for variable configuration for shoring around utility lines, pipes, duct banks and the like.

2. Related Art

There are many systems available for shoring the walls of open excavations. Generally, these systems, or "shoring systems", are made up of large panels for supporting the walls of a trench or hole and a number of supports for holding the panels against their respective walls. With the walls properly supported by shoring, the trench or hole may be accessed by workers in a safe manner.

Of the many systems, there are various designs currently available for shoring. Because examples of such shoring systems may be found with a simple internet search, and because those having skill in the art are already familiar with shoring systems there will be minimal discussion herein. Instead, we describe a longstanding problem in the art that remains unresolved and continues to threaten injury to workers in excavations, refining, mining, and similar operations.

In particular, when digging a trench or hole, it is often the case that unexpected utility lines, pipes, and/or duct banks appear during an excavation. This usually occurs because of the number of entities involved in grounding utility lines, thus the land may be subject to failed communication or documentation, errors in blueprints, etc. When confronting the unexpected, traditional shoring systems may not be suitable for shoring near these problematic areas.

For example, an unexpected pipe crossing perpendicular to a known line results in a shoring panel being vertically limited. Thus, the trench wall beneath the unexpected pipe is not properly shored. Depending on the depth of the trench, this could lead to harmful, and potentially fatal, conditions. There has yet to be developed a shoring system for meeting these and other commonly occurring situations.

In another example, older cities, especially large cities and other urban areas, often have a large number of utility lines, cables, pipes, and other obstructions that are encountered when trenching in these areas. This spider-web like mess of lines can often be problematic for shoring since current systems are not capable of being installed in these areas. Again, there has yet to be provided a configurable shoring system suitable for shoring walls with large numbers of crossing utilities.

Other problems in the art will become apparent in the following descriptions of the inventive features and embodiments.

SUMMARY OF THE INVENTION

In accordance with the features and embodiments disclosed herein, a shoring box comprises two or more frames adapted for assembly via a plurality of spreaders extending therebetween. The frames are each adapted to receive up to one or more exterior panels configured for vertical translation about an exterior surface thereof. The frames are each further adapted to receive up to one or more interior panels adapted for configurable attachment about an interior surface thereof. In this regard, the shoring box comprises exterior shoring panels capable of vertical translation, and interior panels capable of being attached below crossing pipes and other utilities. The shoring box is reconfigurable as depth of the trench may vary during an excavation project. One or more shoring boxes can be stacked vertically depending on the required depth for shoring.

In various embodiments, each of the support frames of the shoring box do not a have a horizontal support or brace at the bottom end thereof. In this regard, the shoring box is capable of dropping around utility lines and other obstacles without being obstructed by these obstacles. Thus, with the support frames capable of dropping below the vertical height of the obstructions, one or more interior panels can be added to the system below the obstacle to complete shoring within the excavation area.

In one embodiment, a shoring box comprises a first support frame, a second support frame, one or more exterior panels, one or more interior panels, and one or more spreaders. The first support frame further comprises a horizontal upper support extending from a proximal end to a distal end; two or more vertical posts, each of the vertical posts having an upper end and a lower end, wherein each of the vertical posts is attached to the horizontal upper support at the upper end thereof; one or more pairs of opposing rails, the pairs of opposing rails each comprising a first opposing rail being vertically disposed along a first vertical post of the two or more vertical posts and a second opposing rail being vertically disposed along a second vertical post of the two or more vertical posts, the first and second opposing rails being disposed on an outer frame surface of the first support frame; one or more slots being vertically aligned along the first vertical post from the lower end and toward the upper end thereof on an inner frame surface, the inner frame surface being opposite the outer frame surface; one or more apertures being vertically aligned along the second vertical post from the lower end and toward the upper end thereof on the inner frame surface; and one or more receiver cups or receiver cradles being evenly spaced about the inner surface of the vertical posts. The second support frame is substantially similar to the first support frame. At least one of the exterior panels is adapted to slideably engage with the exterior surface of the first support frame at one of the one or more pairs of opposing rails. Each of the interior panels has a first end adapted to fit within one of the slots and a second end comprising an attachment mechanism adapted to engage one of the apertures for removable attachment about the interior surface of one of the support frames. The spreaders individually comprise an elongated structure extending from a first end to a second end thereof, the spreaders are configured to be removably engaged with one of said receiver cups or receiver cradles at each of the first and second ends. The first support frame and second support frame are configured for attachment via the spreaders extending therebetween. Each of the one or more exterior panels are individually adapted for vertical translation about an exterior surface of the shoring box; and each of the one or more interior panels are configured for removable attachment along an interior surface of the shoring box.

In another aspect, a method for assembling a shoring box in accordance with the embodiments disclosed herein comprises: orienting a first support frame and a second support frame such that the second support frame is substantially parallel with the first support frame; connecting the first and second support frames by attaching one or more spreaders therebetween; slideably engaging at least one exterior panel within a channel disposed about one or more of the support frames such that the at least one exterior panel is configured for slideable translation along a vertical direction; and attaching one or more interior panels about an interior surface of at least one of the first and second support frames.

Other features and benefits of the invention will be described in further detail within the following detailed description of the preferred embodiments.

DETAILED DESCRIPTION OF THE PREFERRED EMBODIMENTS

In the following description, for purposes of explanation and not limitation, details and descriptions are set forth in order to provide a thorough understanding of the present invention. However, it should be apparent to those skilled in the art that the present invention may be practiced in other embodiments that depart from these details and descriptions without departing from the spirit and scope of the invention.

In accordance with various embodiments, a shoring box is disclosed. The shoring box generally comprises a pair of similar support frames adapted for attachment with a plurality of spreaders therebetween to form a scaffold structure. Each of the frames further comprises at least one pair of opposing rails oriented in a manner for slideably receiving a planar exterior panel. Moreover, the support frames further comprise a plurality of slots being vertically disposed and adapted to receive one or more interior panels. In this regard, the shoring box comprises a scaffold structure adapted to provide vertically translating exterior panels and one or more interior panels for use as an additional or alternative shoring support.

The shoring box is capable of configuration about a trench having a pipe or other utility structure obstructing an orthogonal path of trench. For example, where there resides a pipe, line, duct bank, or other utility obstruction extending in a direction orthogonal to the trench, the scaffold structure of the shoring box disclosed herein is adapted to drop around the obstruction, one or more exterior panels is adapted to contact the obstruction and vertically translate as the support frame and scaffold structure drop around the obstruction. Next, with the area of the trench wall below the obstruction being exposed, a plurality of interior panels can be added to an interior surface of the shoring box by sliding one end of each interior panel into a respective slot of the frame supports, and a engaging locking means such as a rotating handle or latch with an adjacent aperture for securely attaching each interior panel.

Although certain preferred embodiments are illustrated and described, it should be noted that upon review of this disclosure other features and alternatives will become readily conceivable to those having skill in the art. Thus, in a generic embodiment, the invention comprises a configurable shoring device comprising two similar support frames and a plurality of spreaders disposed therebetween, one or more exterior panels, and one or more interior panels.

In addition to crossing utility lines, the shoring box can be used in a variety of applications, including utility trenching, refining, precious material mining, and natural gas extractions. Other applications where excavations or trenching is required may further represent potential uses.

Each of the components herein may be individually fabricated from steel, aluminum, or other metals, plastics or composite materials, wood, or any combination thereof.

Figure 1:
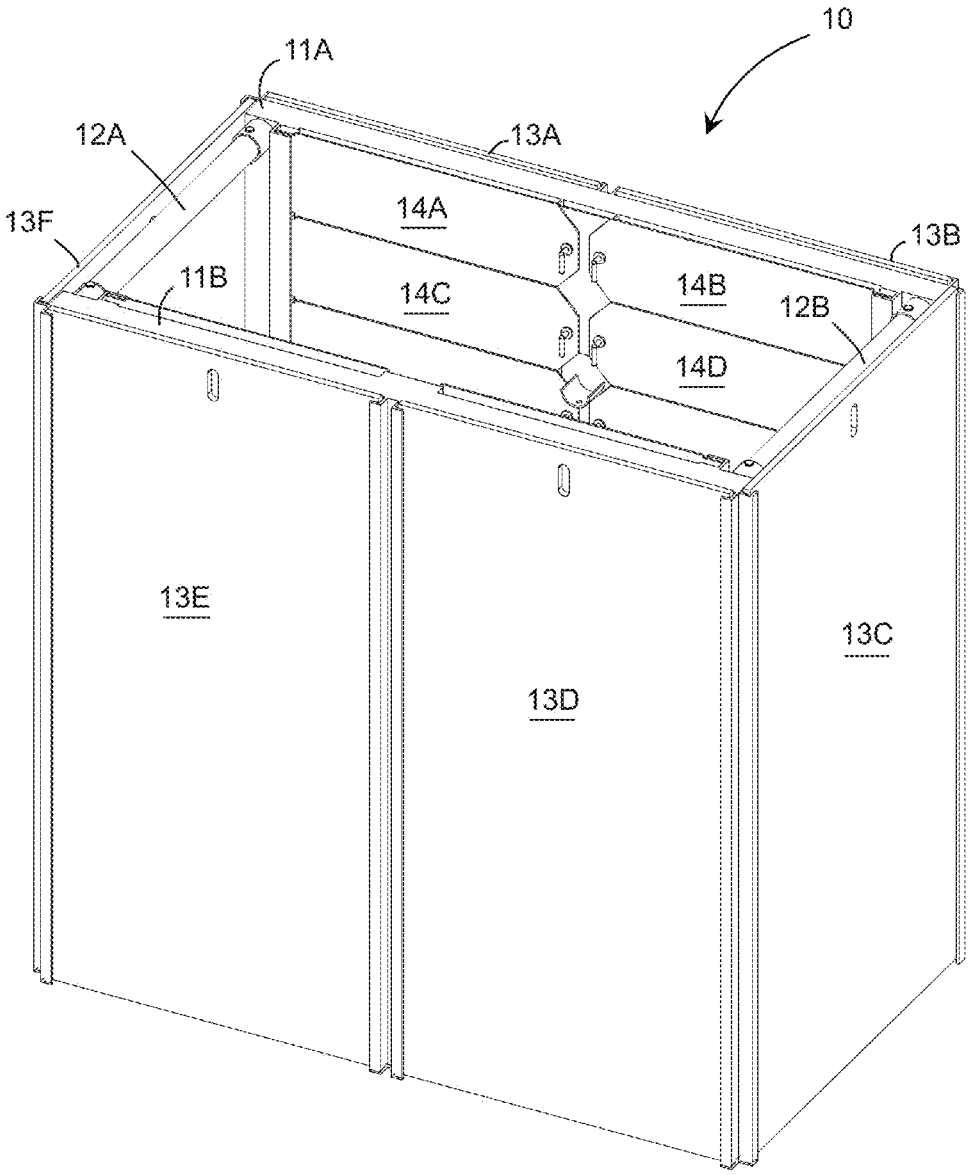
FIG. 1 illustrates a shoring box in accordance with an embodiment of the invention, the shoring box comprises a pair of similar support frames, a plurality of spreaders, a plurality of exterior panels, and a plurality of interior panels.

Now turning to the figures, FIG. 1 illustrates a shoring box 10 in accordance with one embodiment. The shoring box 10 comprises a pair of similar support frames 11A; 11B being oriented parallel with one another and coupled with a plurality of spreaders 12A; 12B being disposed therebetween to form a scaffold structure. The support frames forming the scaffold structure are adapted to receive a plurality of planar exterior panels 13A-13F for shoring one or more walls of a trench, hole or excavation. The shoring box is adapted to receive the exterior panels about up to an entire perimeter of the shoring box. Additionally, the support frames are adapted to receive one or more interior panels 14A-D for providing a second layer of shoring.

Figure 2:
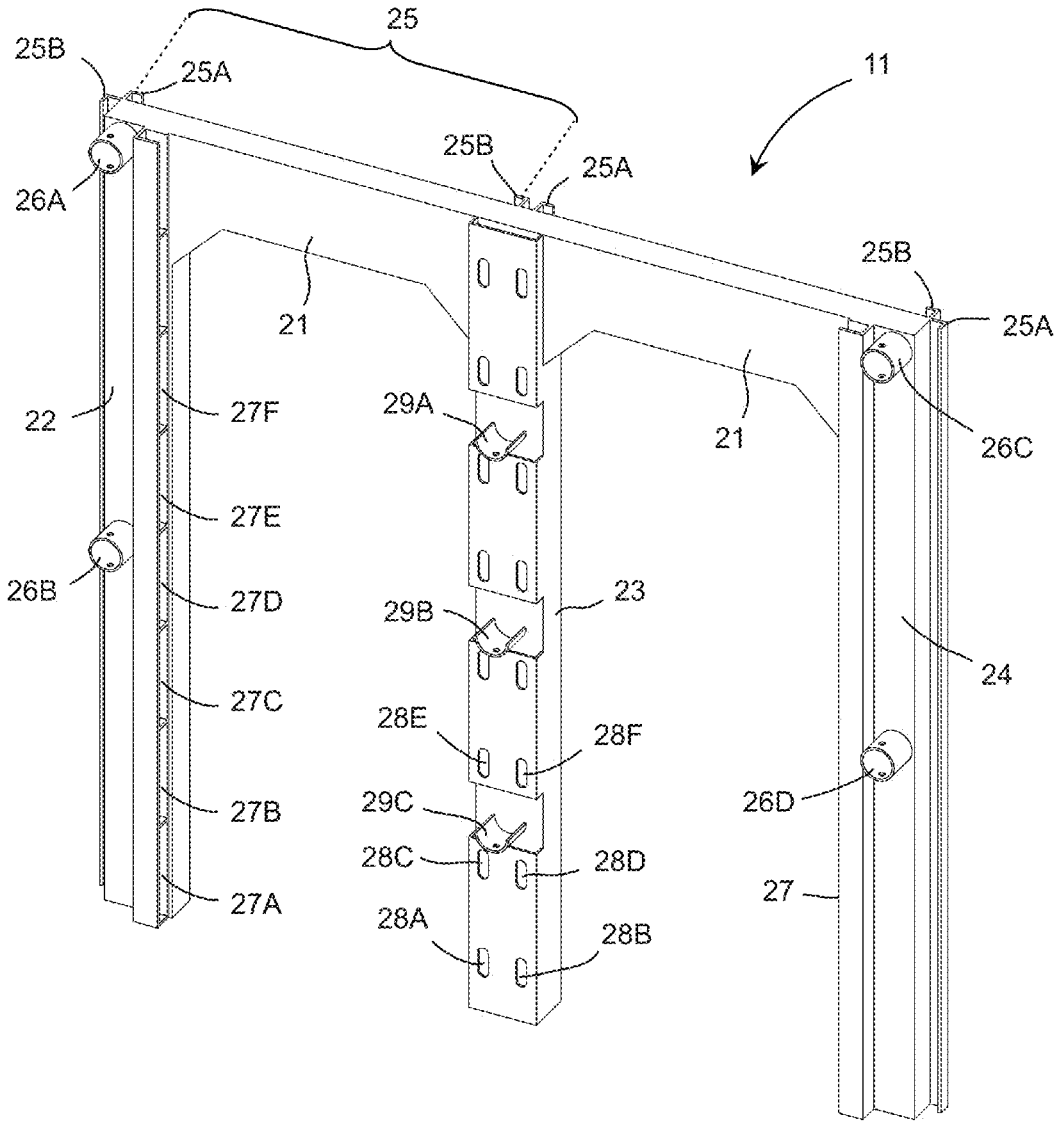
FIG. 2 illustrates a rear perspective view of a support frame in accordance with an embodiment; the support frame further comprises a plurality of vertically disposed slots, a plurality of apertures, and a plurality of receiver cups.
Figure 3:
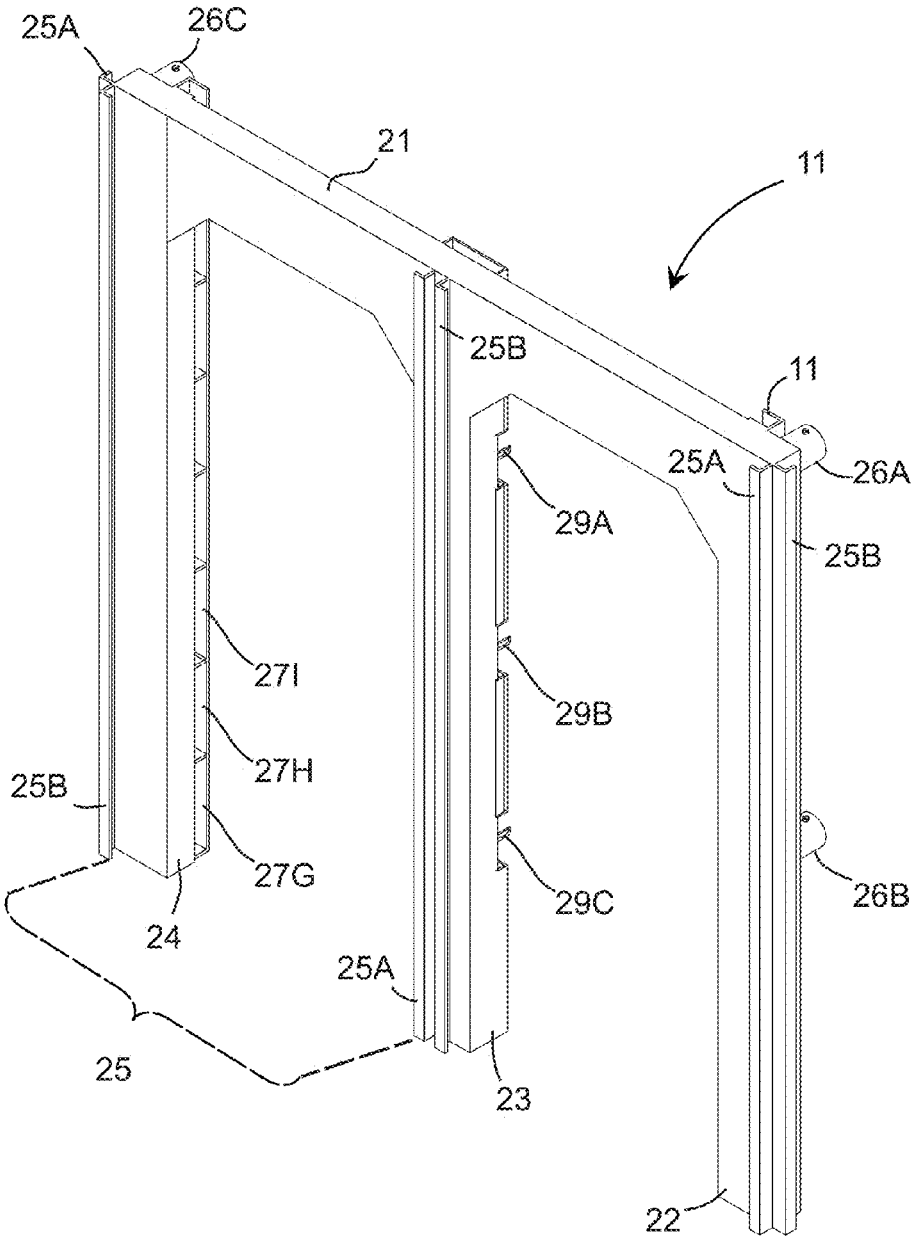
FIG. 3 illustrates a front perspective view of a support frame in accordance with the embodiment of FIG. 2; the support frame further comprises opposing rails for slideably receiving an exterior panel.

FIG. 2 illustrates a rear perspective view of a support frame 11. The support frame 11 comprises a first vertical post 22, a second vertical post 23, and a third vertical post 24 to form an "M" shape, or "M-frame". It should be noted that in other embodiments, a support frame may comprise two or more vertical posts, such a frame having two-vertical posts can be referred to as an "A-frame". Each of the vertical posts 22-24 is adapted to be attached to a horizontal upper support 21 at an upper end. The horizontal upper support 21 extends from a proximal end to a distal end, with a vertical post attached at each end. Each of the vertical posts can be viewed as having a lower end and an upper end, wherein each of the vertical posts 22-24 are attached to the horizontal upper support 21 at an upper end thereof. The frame support further comprises one or more slots 27A-F being vertically aligned along a first of the vertical posts 22 from the lower end thereof and toward an upper end along the inner frame surface. The inner frame surface as depicted in the rear perspective view is disposed opposite of an outer frame surface as will be disclosed in FIG. 3. Moreover, the support frame further comprises a plurality of apertures 28A-F being vertically disposed about an inner frame surface of a second of the vertical posts 23 from a lower end to an upper end thereof, and one or more receiver cups 26A-D or receiver cradles 29A-C being disposed about the inner frame surface. Receiver cups 26A-D comprise circular receptacles adapted to receive and attach with an entire circumference of the spreaders, whereas receiver cradles 26A-C comprise a shelf for abutting less than an entire circumference of a spreader for attachment to a support frame 11. A pair of opposing rails 25 comprises a first rail 25A vertically disposed about a first vertical post 22, and a second rail 25B being vertically disposed along a second vertical post 23. Multiple rails are positioned about a support frame FIG. 3 illustrates a front perspective view of an M-frame style support frame 11 in accordance with an embodiment. The support frame 11 further comprises one or more pairs of opposing rails 25 configured to receive an exterior panel. The opposing rails 25 each comprise a first rail 25A being vertically disposed about an outer frame surface of a first vertical post 22; 24, and a second rail 25B being oppositely oriented and disposed along an outer frame surface of a second vertical post 23. The opposing rails are configured to form a channel 25, within which a planar exterior panel may be inserted and slideably received. Receiver cups 26A-C and receiver cradles 29A-C are visible. Additionally, a second plurality of slots 27G-I are shown extending vertically along the third vertical post 24.

A side surface of each support frame may comprise a rail 25A; 25B for receiving a planar exterior panel at a side of the shoring box.

In a preferred embodiment, at least a portion of the horizontal support 21 and vertical posts 22-24 may be hollowed for providing a lightweight support frame. Alternatively, one or more portions of the frames can be cast to form a solid matrix for added strength, however, it will be noted that solid frames may possess a significant increased weight.

Figure 4A:
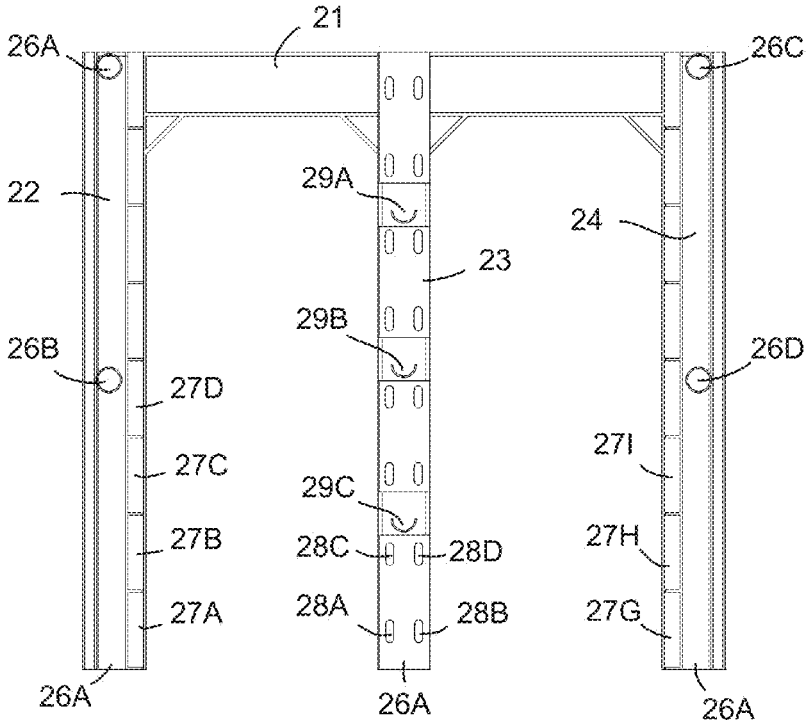
FIG. 4*a* illustrates a rear view of a support frame in accordance with the embodiment of FIGS. 2-3.

FIG. 4*a* illustrates a rear view of an M-Frame style support frame having a horizontal upper support 21 attached to three vertical posts 22-24 at the upper ends thereof. The support frame does not comprise a horizontal support extending between the vertical posts at the lower ends. In this regard, the support frame is adapted to drop into a trench or other excavation in a manner for circumventing obstructions that may lie therein. The M-frame style support frame comprises one or more receiver cups 26A-D or receiver cradles 29A-C disposed on an inner surface, one or more apertures 28A-D are disposed vertically along a second vertical post 23, and one or more slots 27A-D are disposed vertically along a first vertical post 22. Additional slots are disposed vertically about an inner side surface of a third vertical post 24 of the M-style support frame.

Each of the receiver cups and receiver cradles is adapted to receive and attach with a spreader. The receiver cups and receiver cradles may be pre-drilled to comprise a hole for extending a bolt or pin therethrough in a manner for engaging the received spreader. In this regard, the spreader may also be pre-drilled to receive the bolt or pin.

Each of the slots is configured to at least partially receive a portion of an inserted interior panel. Thus, multiple interior panels may span vertically about the inner surface of the M-style support frame.

Figure 4B:
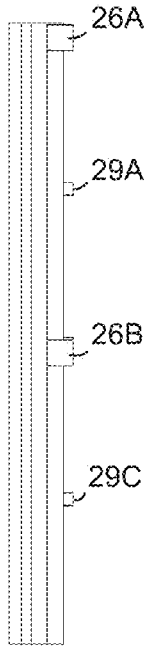
FIG. 4*b* illustrates a side view of the support frame.

FIG. 4*b* illustrates an inner side view of a vertical post having slots as described and illustrated in FIG. 4*a*. Additionally, one or more receiver cups 26A; 26B, and one or more receiver cradles 29A; 29C, are illustrated by way of a side view.

Figure 4C:
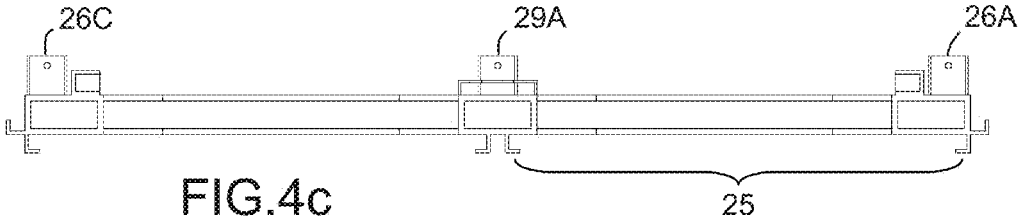
FIG. 4*c* illustrates a top view of the support frame.

FIG. 4*c* illustrates a top view of the M-style support frame wherein the opposing rails are shown forming respective channels for receiving planar exterior panels. Receiver cups are illustrated by way of a top view.

Figure 4D:
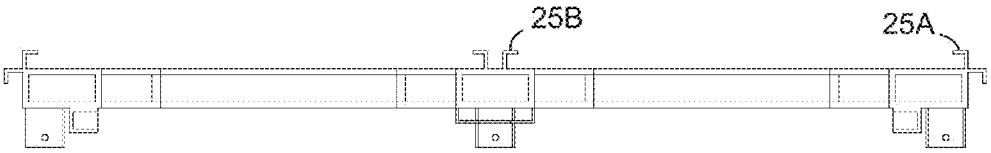
FIG. 4*d* illustrates a bottom view of the support frame.

FIG. 4*d* illustrates a bottom view of the M-style frame and opposing rails 25A; 25B and channels 25 formed therebetween. Additionally, receiver cups 26A; 26C and receiver cradles 29A are illustrated by way of a top view.

Figure 5:
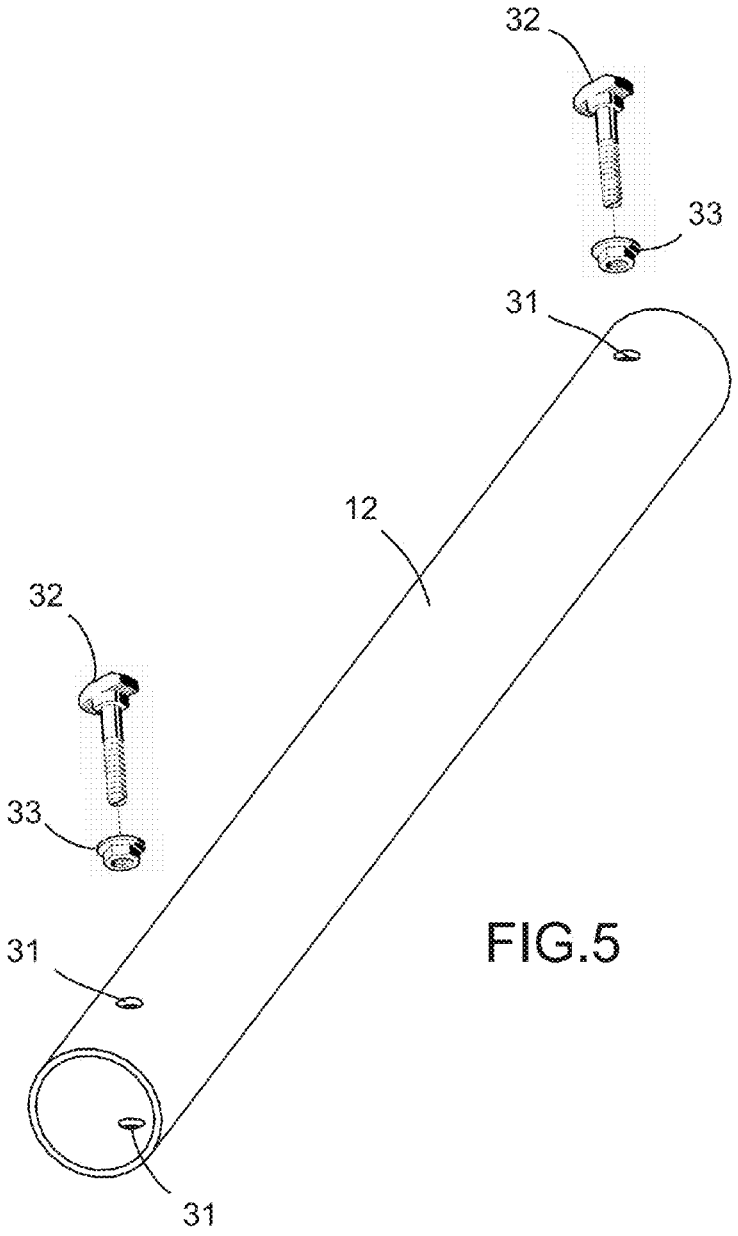
FIG. 5 illustrates a spreader in accordance with an embodiment of the invention, the spreader is adapted to be secured to a support frame at each end thereof via a bolt or pin.

FIG. 5 illustrates an example of a spreader 12 for attaching a pair of support frames. Bolts 32 are illustrated as being capable of inserting through holes 31 in the spreader 12 and attaching with receiver cups or receiver cradles of the support frame. A nut 33 is used to secure the bolt-through attachment of the spreaders to the frames. It should be noted that hollow or solid core spreaders may be used. Further, the spreaders may be capable of configuration between an expanded length and a collapsed length. Adjustable spreaders are available commercially and are not being illustrated or described in detail herein. However, it should be understood that the spreaders may be cylindrical in shape, or alternatively may comprise square tubing or various other designs.

Figure 6:
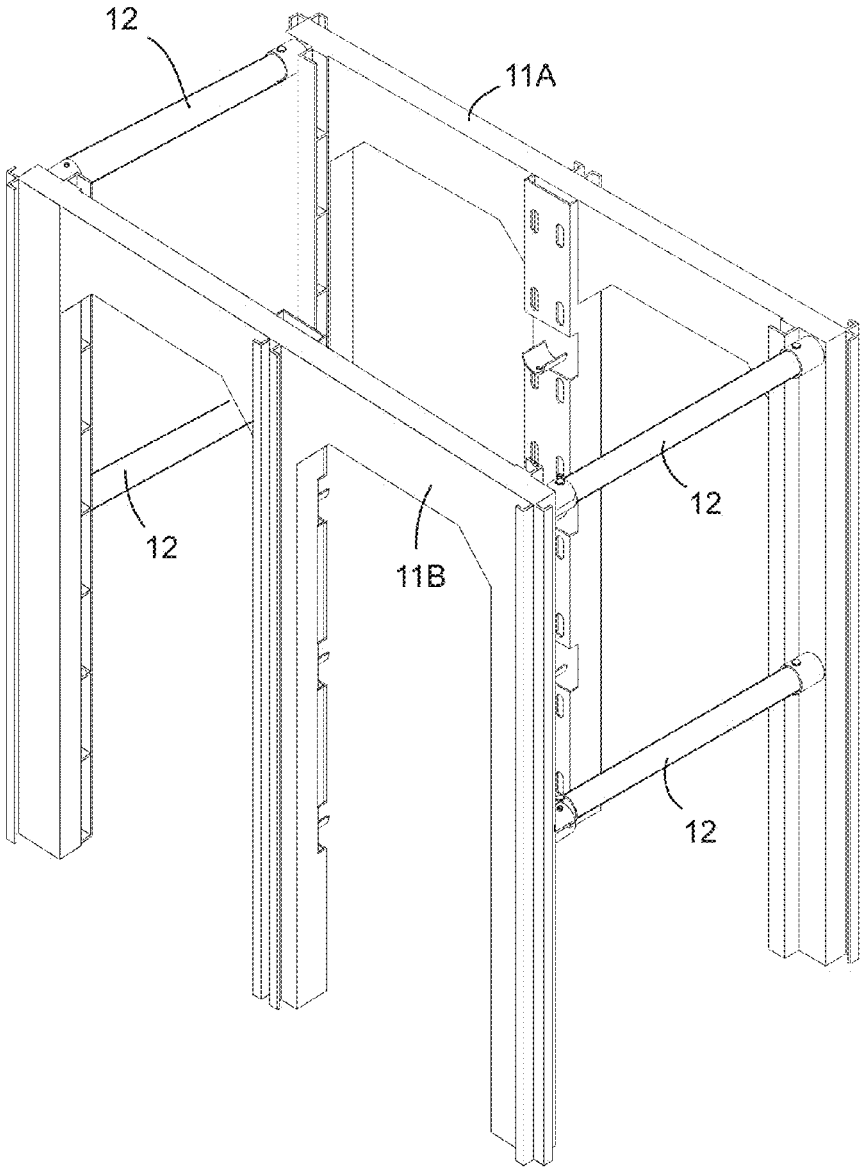
FIG. 6 illustrates a scaffold support structure comprising a pair of similar support frames and a plurality of spreaders attached therebetween.

FIG. 6 illustrates a scaffold structure comprising a first support frame 11A, a second similar support frame 11B being aligned parallel with the first support frame 11A, and a plurality of spreaders 12 extending therebetween. The scaffold structure may be assembled within a trench or prior to dropping into a trench or excavation. However, it is preferred to assemble the scaffold outside of the trench and then drop in an assembled shoring box into the trench such that workers may be protected at all times within the trench. The scaffold structure is being shown with the spreaders being attached to the support frames using bolts or pins, however other attachment means can be used. Upon assembling the scaffold structure, the unit becomes ready to accept planar exterior panels and interior panels for shoring walls of the trench or excavation.

Figure 7:
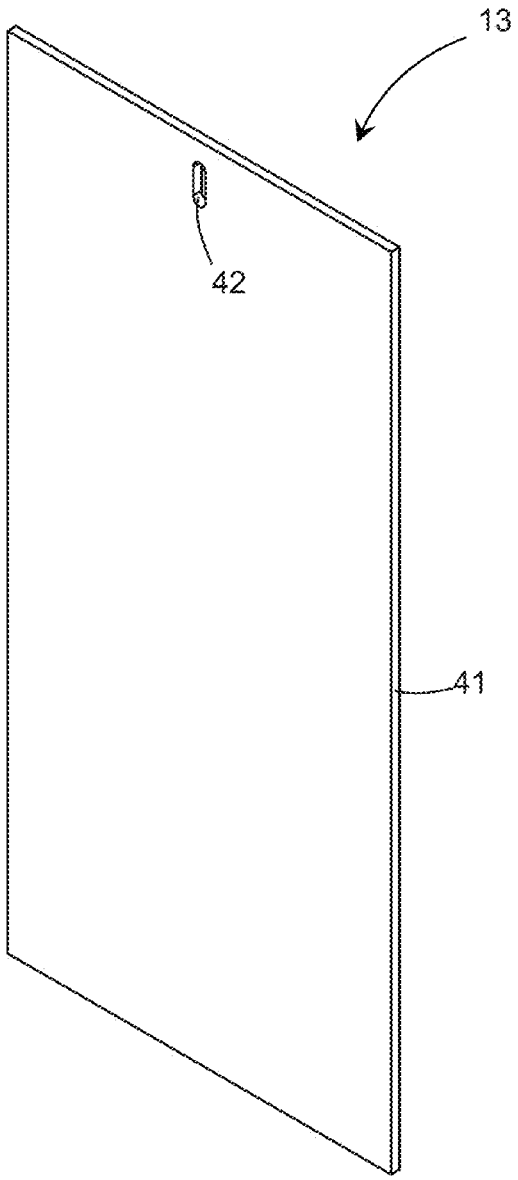
FIG. 7 illustrates an exterior panel in accordance with an embodiment of the invention.

FIG. 7 illustrates an exterior panel 13 for use in the shoring box in accordance with various embodiments herein. The exterior panel comprises a planar sheet 41 adapted to fit within a channel of a support frame as described above. The planar exterior panel 13 may further comprise a hole 42, aperture, hook, or ring for attaching a cable or other means for lifting and lowering the panel about the channel or opposing rails. The thickness of the exterior panel can vary and may depend on the requirements for strength of the shoring box and weight. Regulatory protocols may require tabulated data for ensuring minimum fatigue resistance and integrity and thus the thickness of the exterior panels may be subject to engineering data results for a number of designs and embodiments of the shoring box. However, the thickness of the exterior panels should be configured to fit within a vertical channel formed from the opposing rails of the support frame. Additionally, a minimum allowable thickness will enable faster and easier assembly since the reduced weight of the panels may reduce the number of workers and/or equipment required to assemble the shoring box.

Figure 8A:
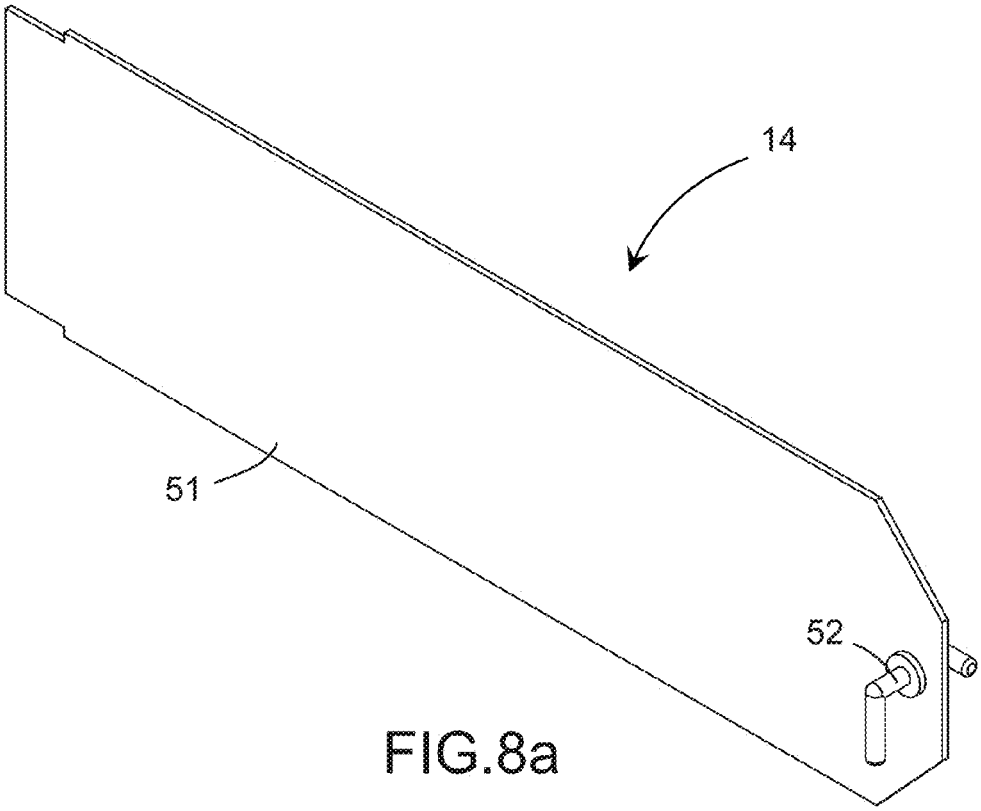
FIG. 8*a* illustrates an interior panel and a locking mechanism coupled therewith.
Figure 8B:
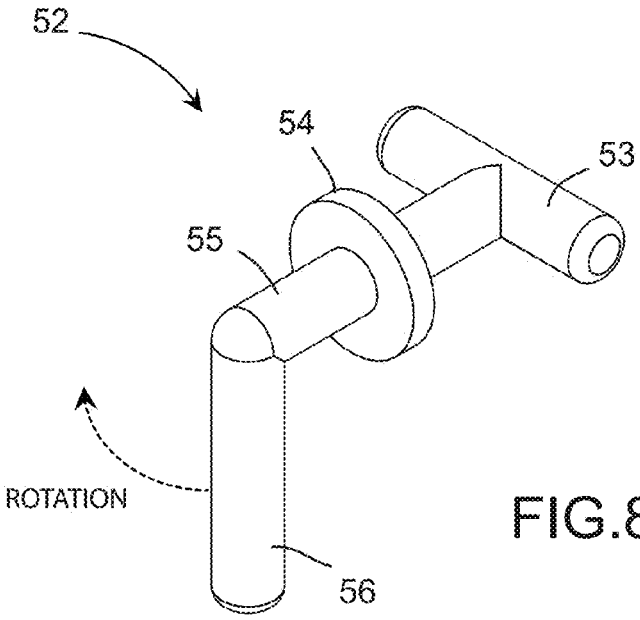
FIG. 8*b* illustrates the locking mechanism in accordance with the embodiment of FIG. 8*a*.

FIG. 8*a* illustrates an example of an interior panel 14 and attachment mechanism 52. The interior panel 14 comprises a planar sheet 51 having a first end adapted to fit within one of the slots of the support frames, and extends toward a second end comprising the attachment mechanism 52. The attachment mechanism 52 illustrated in FIG. 8*a* can be referred to as a "locking pin". FIG. 8*b* illustrates an example of an attachment mechanism 52 comprising a T-shaped handle 53 and a bent pin 56; 56 for engaging an aperture of the respective support frame and rotationally securing into a locked position. A bearing 54 may be provided for enabling rotational movement of the attachment mechanism. Other attachment mechanisms, such as latches, locks, and other mechanisms may be utilized in a similar fashion.

Figure 9:
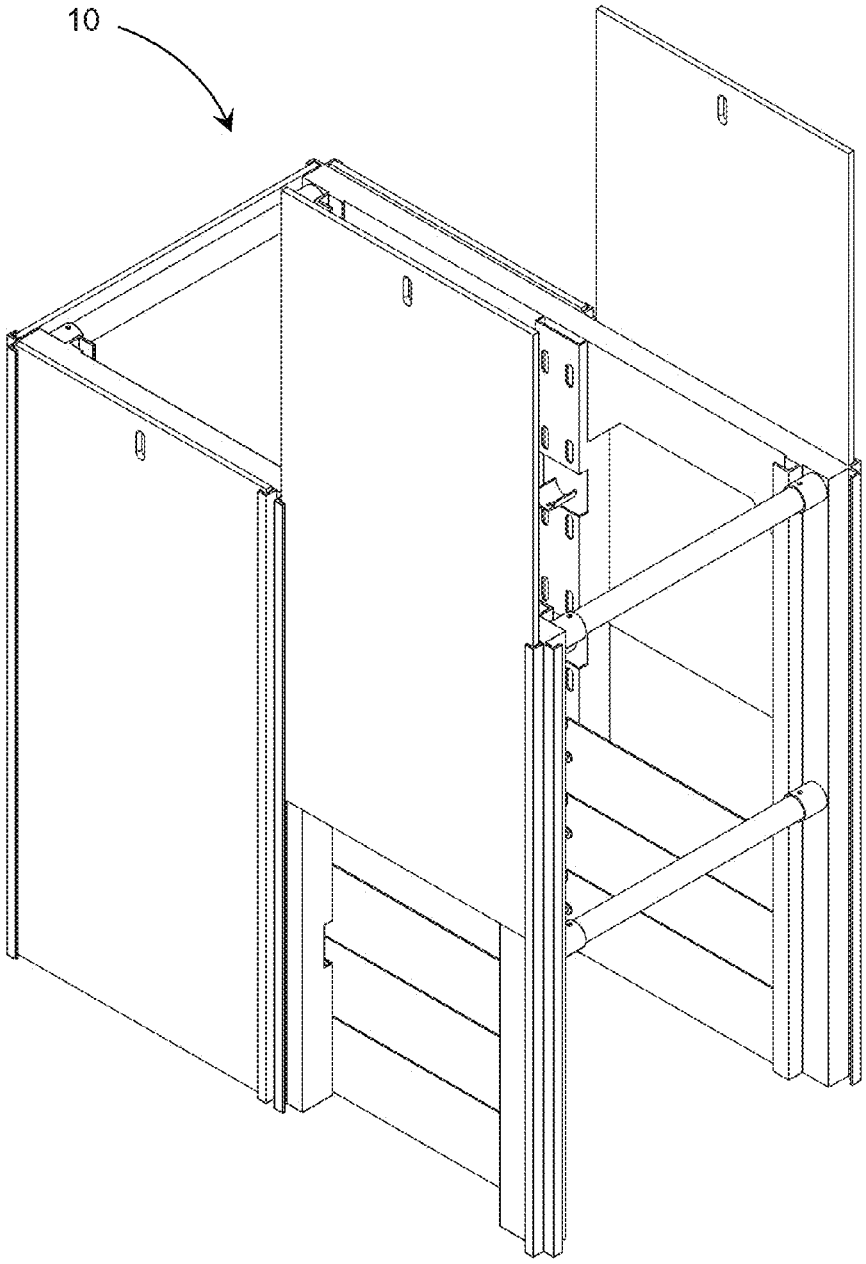
FIG. 9 illustrates an assembled shoring box in accordance with an embodiment; the shoring box comprises a plurality of exterior panels adapted for vertical translation about an exterior surface of a frame support.

FIG. 9 illustrates the shoring box 10 described above. The shoring box 10 is adapted to be installed or dropped within an excavation and provides shoring support against the walls of the excavation for providing safety to workers who may subject to working therein. The planar exterior panels of the shoring box 10 are illustrated as being slideably translated in a vertical direction. The slideable translation allows the scaffold structure of the shoring box to completely drop within a trench when confronting an obstruction such as a pipe being orthogonally disposed with respect to the trench, a duct bank, or other obstruction. With the exterior panel providing shoring support above the obstruction, the scaffold structure continues to drop below the obstruction and one or more interior panels may be attached for providing shoring support beneath the obstruction. Multiple obstructions can be circumvented using the described shoring box 10.

One or more shoring boxes can be stacked vertically for achieving shoring about deep excavations.

Figure 10:
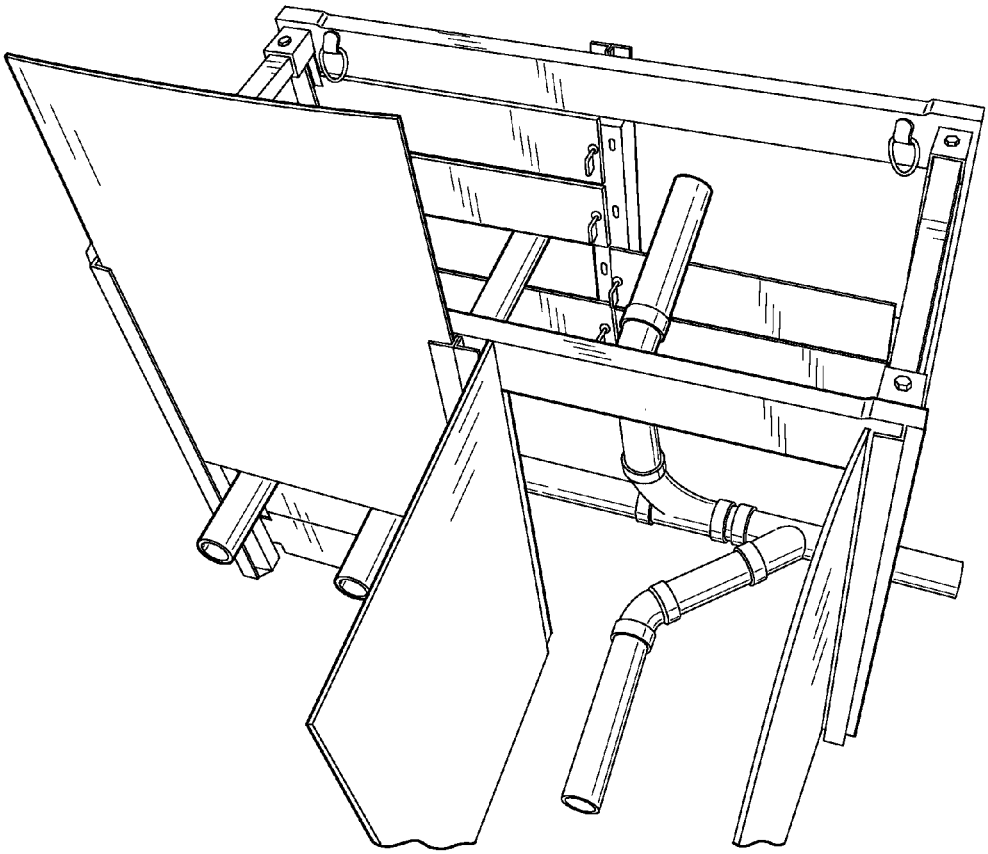
FIG. 10 is a photograph of a scaled prototype of a shoring box in accordance with an embodiment of the invention; a pipe structure is shown within the shoring box.

FIG. 10 is a photograph of a scaled prototype of a shoring box in accordance with an embodiment of the invention; a pipe structure is shown within the shoring box. The model illustrates a perpendicular line of pipe exiting a bottom right corner of the shoring box wherein two exterior panels are shown and thereby representing a location of an orthogonally placed shoring box. At a rear right side of the model, a second pipe having a different elevation is shown exiting the shoring box and a number of interior panels are placed below the pipe. At a bottom left corner of the model, a plurality of pipes are shown exiting the shoring box, the exterior panel above the pipes is translated vertically and shores an area above the pipes and a plurality of interior panels are added below the pipes for shoring an area below.

Figure 11:
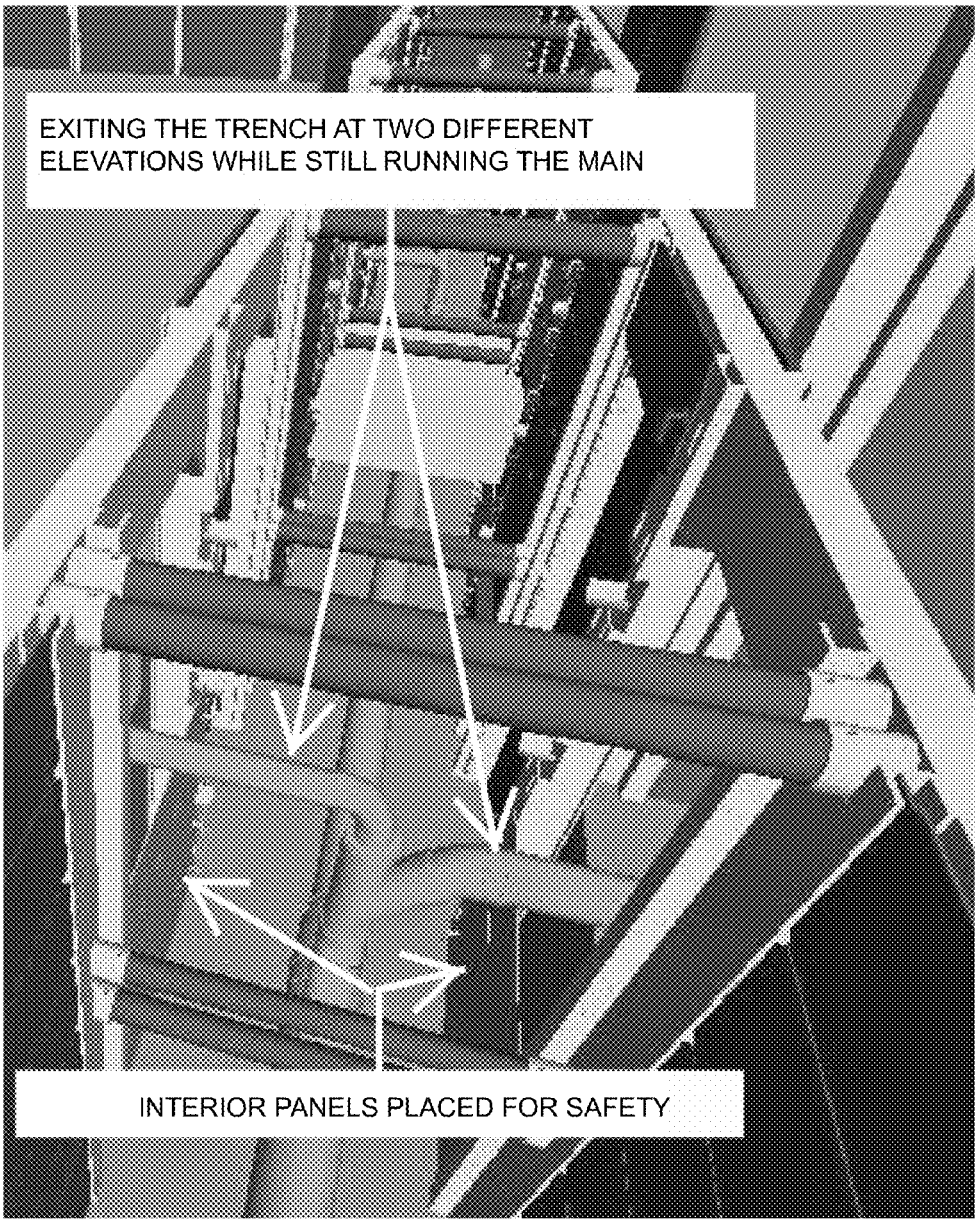
FIG. 11 illustrates a trench having a plurality of shoring boxes extending thereabout, a pipe within the trench comprises two portions exiting the trench at different elevations, the shoring box is configured with raised exterior panels and added interior panels for maximum shoring of the trench.

FIG. 11 illustrates a trench having a plurality of shoring boxes extending thereabout, a pipe within the trench comprises two portions exiting the trench at different elevations, the shoring box is configured with raised exterior panels and added interior panels for maximum shoring of the trench.

Figure 12:
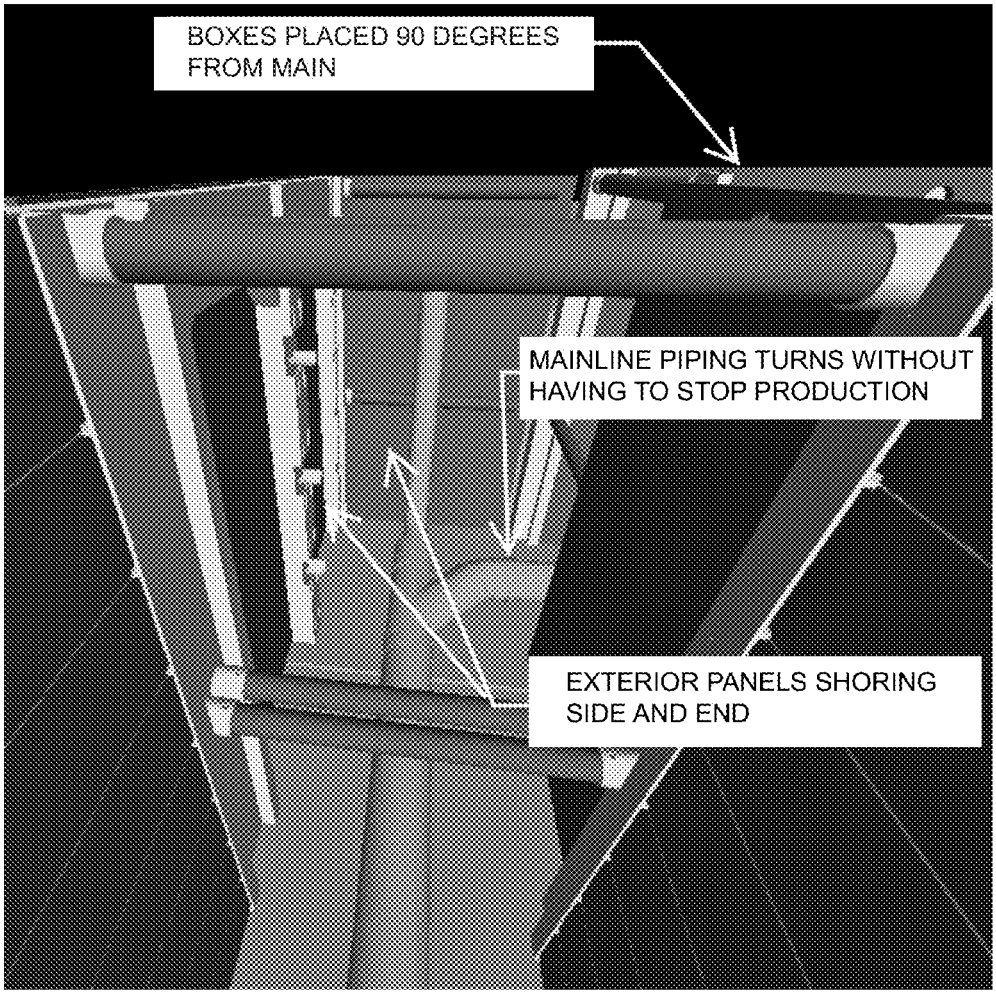
FIG. 12 illustrates a trench having a pipe system turning at an end thereof, a plurality of shoring boxes in accordance with the invention are configured about the trench at the turn.

FIG. 12 illustrates a trench having a pipe system turning at an end thereof, a plurality of shoring boxes in accordance with the embodiments herein are configured about the trench at the turn. A shoring box is rotated ninety degrees and is placed orthogonal to another shoring box at the terminal end of the trench such that the turned pipe line can be similarly shored.

Figure 13:
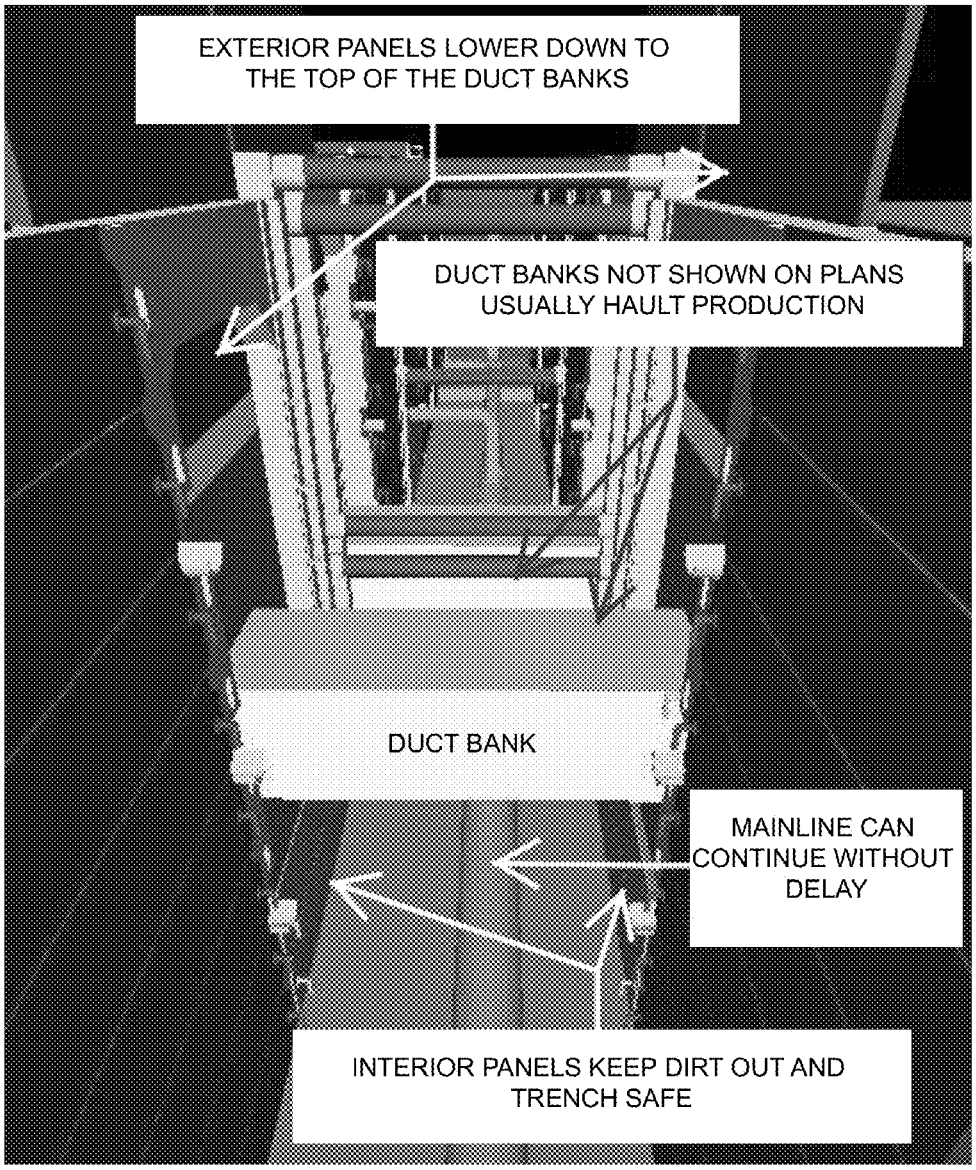
FIG. 13 illustrates a trench having a duct bank therein, a plurality of shoring boxes in accordance with embodiments of the invention are placed therein, exterior panels are vertically raised and interior panels are added below the obstructions.

FIG. 13 illustrates a trench having a duct bank therein, a plurality of shoring boxes in accordance with various embodiments are placed therein, exterior panels are vertically raised about the duct bank and interior panels are added below the duct bank. Although a duct bank is shown, the shoring box configuration is similar for other types of obstructions.

In another aspect of the invention, a method for assembling the shoring box as described above comprises: orienting a first support frame and a second support frame such that the second support frame is substantially parallel with the first support frame; connecting the first and second support frames by attaching one or more spreaders therebetween; slideably engaging at least one exterior panel within a channel disposed about one or more of said support frames such that said at least one exterior panel is configured for slideable translation along a vertical direction; and attaching one or more interior panels about an interior surface of at least one of the first and second support frames.

In one preferred embodiment, at least four spreaders are attached at respective receiver cups of two support frames.

The shoring box scaffold structure, comprising two support frames and one or more spreaders attached therewith, is generally assembled outside of the trench or excavation. Often, one or more of the exterior panels are further installed into the shoring box prior to dropping the assembled box into the trench.

The method for assembly of the shoring box may further comprise: adjusting a length of the spreaders prior to connecting the support frames; slideably engaging a plurality of exterior panels with a plurality of respective channels for dressing multiple sides of the shoring box; or stacking multiple shoring boxes to achieve shoring at large depths.

Those having skill in the art will recognize that certain features may be altered to accomplish substantially the same result. Accordingly, nothing in this disclosure is intended to limit the spirit and scope of the invention as shall be set forth in the appended claims.

We claim:

1. A shoring box, comprising:

two or more support frames adapted for attachment via a plurality of spreaders extending therebetween;

said frames each adapted to receive one or more exterior panels configured for vertical translation about an exterior surface of the support frames; and said frames each further adapted to receive one or more interior panels adapted for configurable attachment about an interior surface of the frames;

characterized in that:

the shoring box is configured to drop into a trench or hole having an obstruction therein, wherein said exterior panels are each adapted to vertically translate upon making contact with the obstruction, and wherein said interior panels may be attached to the shoring box about an interior surface thereof for shoring an area below the obstruction.

2. The shoring box of claim 1, wherein said exterior panels are adapted for slideable engagement with said frames.

3. The shoring box of claim 1, wherein each of said interior panels is vertically disposed one above another.

4. The shoring box of claim 1, wherein each of said frames does not comprise a horizontal support attached at a lower end thereof.

5. A method for shoring a trench having an obstruction therein, the method comprising:

providing the shoring box of claim 1;

placing said shoring box in the trench;

vertically translating at least one of said exterior panels about the shoring box such that said exterior panels are each configured to abut the obstruction and to shore a portion of the trench above the obstruction; and attaching one or more of the interior panels about the interior surface of the shoring box for shoring the area below the respective obstruction.

6. The method of claim 5, further comprising:

attaching two or more interior panels about the shoring box and beneath the obstruction.

* * * * *